US010663242B1

(12) United States Patent
Porat

(10) Patent No.: US 10,663,242 B1
(45) Date of Patent: May 26, 2020

(54) MAGAZINE POUCH AND LOADER

(71) Applicant: V.M.D. VERSIA MILITARY DESIGN LTD., Ramat Gan (IL)

(72) Inventor: Tamir Porat, Tel Aviv (IL)

(73) Assignee: V.M.D. Versia Military Design Ltd., Ramat Gan (IL)

( * ) Notice: Subject to any disclaimer, the term of this patent is extended or adjusted under 35 U.S.C. 154(b) by 0 days.

(21) Appl. No.: 16/274,343

(22) Filed: Feb. 13, 2019

(51) Int. Cl.
*F41A 9/83* (2006.01)
*F42B 39/02* (2006.01)

(52) U.S. Cl.
CPC ..... *F41A 9/83* (2013.01); *F42B 39/02* (2013.01)

(58) Field of Classification Search
CPC ..... F41A 9/83; F41A 9/82; Y10S 224/931; F42B 39/002
USPC ..... 42/87; 224/931
See application file for complete search history.

(56) References Cited

U.S. PATENT DOCUMENTS 4,657,132 A * 4/1987 Abdo ..... F42B 39/02 206/3
4,720,931 A * 1/1988 Jensen ..... F41A 9/83 42/87
5,533,657 A * 7/1996 Rosen ..... A45F 5/02 224/191
9,182,205 B2 * 11/2015 Sitz ..... F41A 23/18
2007/0278269 A1 * 12/2007 Rogers ..... F41A 9/65 224/239
2013/0270311 A1 * 10/2013 Sitz ..... F41A 23/18 224/255

* cited by examiner

*Primary Examiner* — Jonathan C Weber
(74) *Attorney, Agent, or Firm* — Dekel Patent Ltd.; David Klein

(57) ABSTRACT

A magazine accessory includes a magazine pouch formed with an opening for inserting therein a firearms magazine, and a magazine loader insertable in and removable from the magazine pouch.

7 Claims, 2 Drawing Sheets

MAGAZINE POUCH AND LOADER

FIELD OF THE INVENTION

The present invention relates generally to firearm magazines, and particularly to a combination firearm magazine pouch and magazine loader.

BACKGROUND OF THE INVENTION

Firearms, and in particular handguns, are typically carried within a holster that may have a strap or other engagement mechanism for retaining the firearm until the firearm is removed from the holster by the shooter. Spare ammunition for the firearm is typically carried within magazine pouches worn by the shooter or attached to equipment carried by the shooter.

It is common practice to load cartridges into a firearm magazine by progressive compression of the magazine spring. The cartridges are inserted one at a time against the ever increasing spring resistance as the magazine approaches a fully loaded condition. If the next cartridge is simply loaded against the previously loaded cartridge, it is recognized that considerable force and manual dexterity are required. Accordingly, many magazine loaders have been developed to assist in compressing the magazine spring.

SUMMARY OF THE INVENTION

The present invention seeks to provide a novel combination magazine pouch and loader for holding cartridges and loading them into a firearm magazine, as is described more in detail hereinbelow.

There is provided in accordance with an embodiment of the present invention a magazine accessory including a magazine pouch formed with an opening for inserting therein a firearms magazine, and a magazine loader insertable in and removable from the magazine pouch.

In accordance with an embodiment of the present invention the magazine loader is formed with an opening which aligns with the opening of the magazine pouch when the magazine loader is assembled with the magazine pouch.

In accordance with an embodiment of the present invention the magazine loader includes a tongue with a cartridge contact surface.

In accordance with an embodiment of the present invention the magazine pouch includes a first end made of side walls that define the opening, and at least one of the side walls extends to a second end of the magazine pouch. This side wall that extends to the second end of the magazine pouch may include fastening elements for holding the magazine loader when assembled with the magazine pouch. The fastening elements may include resilient tabs with lips that resiliently snap on to sides of the magazine loader.

In accordance with an embodiment of the present invention the magazine loader includes a cutout portion and the magazine pouch includes a mating portion whose shape complements a shape of the cutout portion, so that when the magazine loader is assembled with the magazine pouch, the cutout portion forms a smooth outer contour with the mating portion.

In accordance with an embodiment of the present invention the magazine pouch includes a garment mounting provision.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
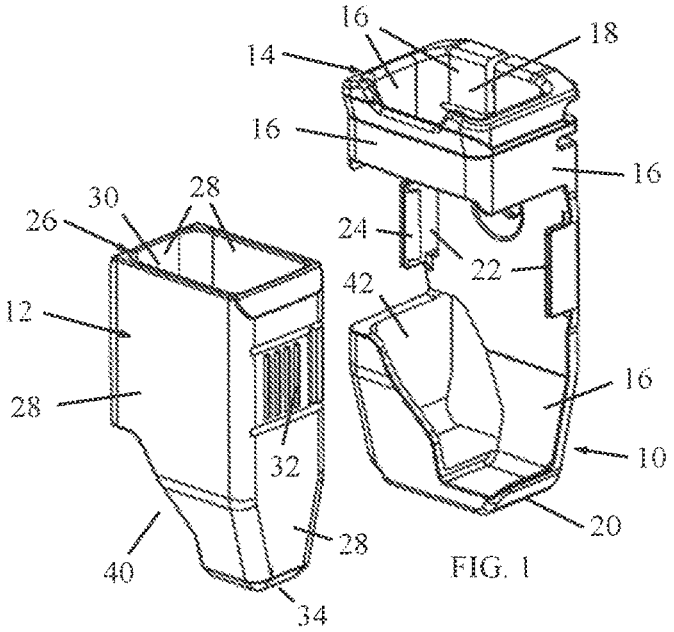
FIG. 1 is a simplified perspective illustration of a magazine loader and magazine pouch, constructed and operative in accordance with a non-limiting embodiment of the present invention.

Reference is now made to FIGS. 1 and 2, which illustrate a combination magazine pouch 10 and loader 12, constructed and operative in accordance with an embodiment of the present invention.

Both the pouch 10 and loader 12 may be constructed of any suitable material, such as but not limited to, metal, plastics (e.g., polycarbonate, nylon, polyethylene terephthalate, thermoformed acrylic-polyvinyl chloride and many more), carbon-fiber composites, and the like.

Figure 3:
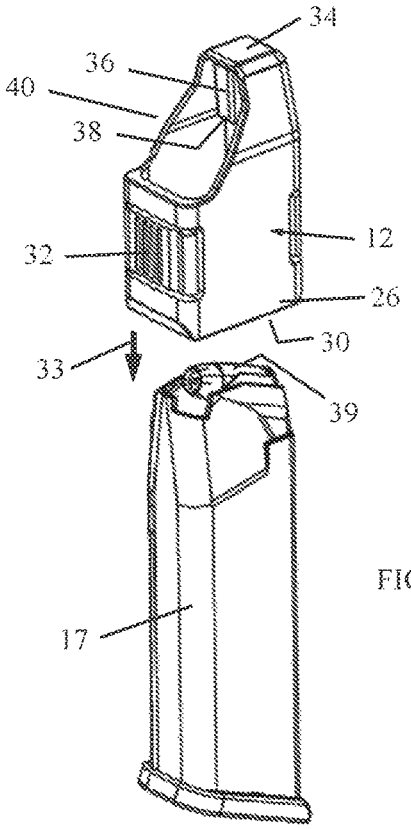
FIG. 3 is a simplified pictorial illustration of using the magazine loader to load a cartridge into a magazine.

Pouch 10 includes a first end 14 made of side walls 16 that define an opening 18 for inserting therethrough a magazine 17 (not seen in FIG. 1 but shown in FIGS. 3-4). At least one of the side walls 16 extends further from the other side walls to a second end 20 of the pouch 10. The second end 20 may be closed. The longer extending side wall may include fastening elements 22 for holding loader 12 when assembled with pouch 10. For example, without limitation, fastening elements 22 may be resilient tabs with lips 24 that can resiliently snap on to sides of loader 12.

Loader 12 may include a first end 26 made of side walls 28 that define an opening 30 for inserting therethrough the magazine 17 (FIG. 3). Two opposing side walls 28 may include one or more ridges 32 that snap and couple with lips 24 of the fastening elements 22 of pouch 10. Some of the side walls 28 extend to a second end 34 of loader 12.

Reference is now made to FIG. 3. Magazine loader 12 may include a tongue 36 that extends inwards from the second end 34 of loader 12. Tongue 36 includes a cartridge contact surface 38. When the magazine 17 enters the opening 30 of the loader 12, the cartridge contact surface 38 is positioned to push a cartridge 39 into magazine 17 by pushing magazine loader 12 downwards in the direction of an arrow 33. Magazine loader 12 has a cutout portion 40 to allow for loader 12 to push cartridge 39 into magazine 17.

Figure 2A:
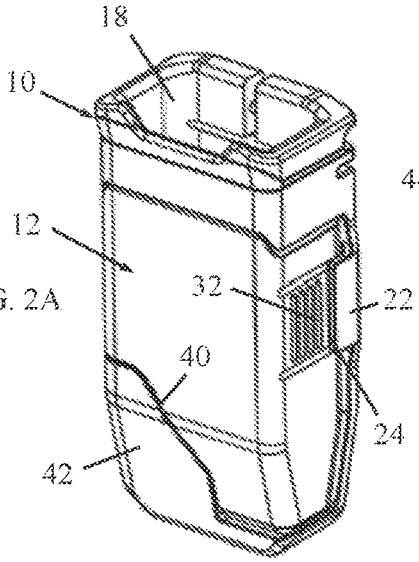
FIGS. 2A, 2B, 2C, 2D, 2E and 2F are simplified front perspective, rear perspective, front view, top view, rear view and left side view illustrations, respectively, of the magazine loader assembled with the magazine pouch.

Referring again to FIG. 1, magazine pouch 10 may include a mating portion 42 whose shape complements the shape of cutout portion 40, so that when loader 12 is assembled with pouch 10, as seen in FIG. 2A, cutout portion 40 forms a smooth outer contour with mating portion 42.

Figure 2B:
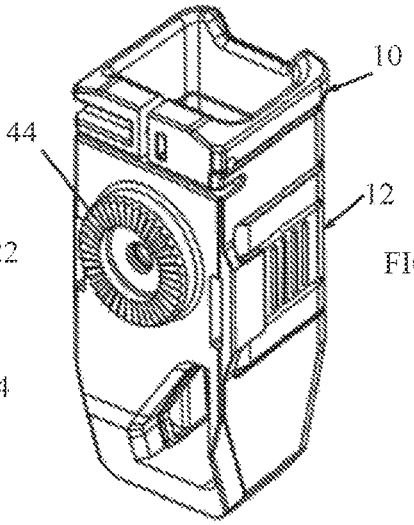
Figure 2C:
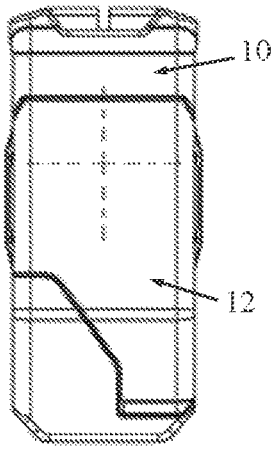
Figure 2D:
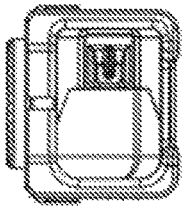
Figure 2E:
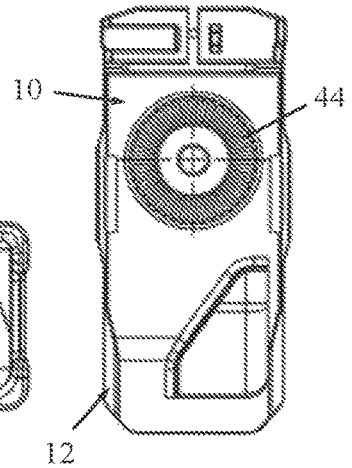
Figure 2F:
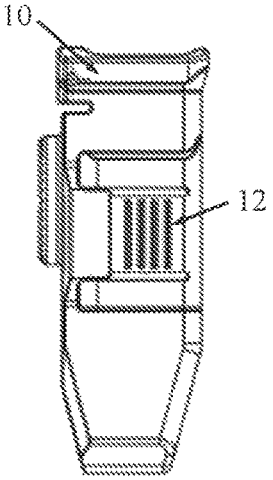

As seen in FIGS. 2B and 2E, magazine pouch 10 may include a paddle hub 44 (which may be serrated) for attaching thereto a paddle (not shown), as is known for example for holsters. Alternatively, magazine pouch 10 may be provided with appropriate loops for inserting a belt therein (not shown). Magazine pouch 10 may in general have any type of garment mounting provision, and paddle hub 44 or belt loops is just one type of garment mounting provision.

Figure 4A:
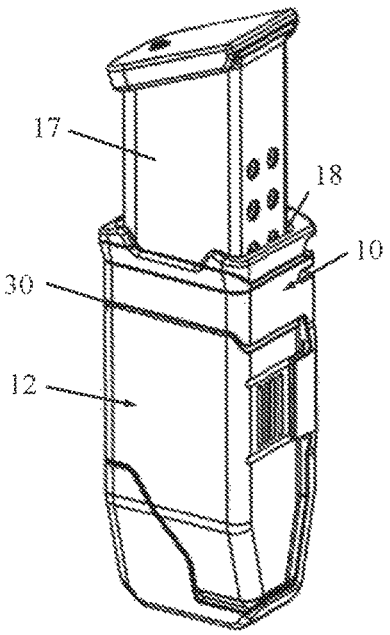
FIGS. 4A and 4B are simplified front and rear perspective illustrations, respectively, of the magazine loader assembled with the magazine pouch and a magazine held in the pouch.
Figure 4B:
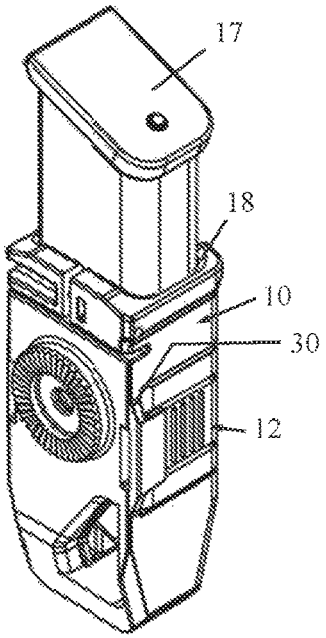

As seen in FIGS. 4A and 4B, when magazine loader 12 is assembled with magazine pouch 10, the opening 30 of the loader aligns with opening 18 of the pouch, so that the magazine 17 fits through both openings and is held in both pouch 10 and loader 12.

What is claimed is:

1. A magazine accessory comprising:

a magazine pouch formed with an opening for inserting therein a firearms magazine; and a magazine loader insertable in and removable from said magazine pouch, wherein said magazine loader comprises a first mating portion and said magazine pouch comprises a second mating portion whose shape complements a shape of said first mating portion, so that when said magazine loader is assembled with said magazine pouch, said first mating portion forms a smooth outer contour with said second mating portion.

2. The magazine accessory according to claim 1, wherein said magazine loader is formed with an opening which aligns with said opening of said magazine pouch when said magazine loader is assembled with said magazine pouch.

3. The magazine accessory according to claim 1, wherein said magazine loader comprises a tongue with a cartridge contact surface.

4. The magazine accessory according to claim 1, wherein said magazine pouch comprises a first end made of side walls that define said opening, and wherein at least one of said side walls extends to a second end of said magazine pouch.

5. The magazine accessory according to claim 4, wherein said at least one of said side walls that extends to said second end of said magazine pouch comprises fastening elements for holding said magazine loader when assembled with said magazine pouch.

6. The magazine accessory according to claim 5, wherein said fastening elements comprise resilient tabs with lips that resiliently snap on to sides of said magazine loader.

7. The magazine accessory according to claim 1, wherein said magazine pouch comprises a garment mounting provision.

* * * * *